US007516842B2

(12) United States Patent
Gu

(10) Patent No.: US 7,516,842 B2
(45) Date of Patent: Apr. 14, 2009

(54) TOOLBOX

(75) Inventor: Xinjun Gu, Zhejiang (CN)

(73) Assignee: Ningbo Hualei Tool Co., Ltd., Zhejiang (CN)

( * ) Notice: Subject to any disclaimer, the term of this patent is extended or adjusted under 35 U.S.C. 154(b) by 504 days.

(21) Appl. No.: 11/335,562

(22) Filed: Jan. 20, 2006

(65) Prior Publication Data

US 2006/0249411 A1 Nov. 9, 2006

(30) Foreign Application Priority Data

Apr. 22, 2005 (CN) ..... 2005 2 0101786 U

(51) Int. Cl.
*A45C 11/26* (2006.01)

(52) U.S. Cl. ..... 206/349; 206/372; 206/373

(58) Field of Classification Search ..... 206/1.5, 206/312, 428, 432, 443, 70, 289, 372–379, 206/349; D3/294; 70/63; 312/333, 902; 220/324, 326; 290/304, 305; 292/80, 87, 292/89, 194, 198, 202, 203, 209, 210, 249, 292/246, 250, 304, DIG. 11; 43/54.1; 24/326–355; D8/336, 338

See application file for complete search history.

(56) References Cited

U.S. PATENT DOCUMENTS

| | | | | | |
|---|---|---|---|---|---|
| 342,502 | A | * | 5/1886 | Dennis | 292/209 |
| 5,125,697 | A | * | 6/1992 | Kahl et al. | 292/204 |
| 5,212,849 | A | * | 5/1993 | Aihara | 16/232 |
| 5,238,142 | A | * | 8/1993 | Hanna et al. | 220/772 |
| 5,680,932 | A | * | 10/1997 | Dickinson et al. | 206/372 |

* cited by examiner

*Primary Examiner*—George Nguyen
*Assistant Examiner*—Kaushikkumar Desai
(74) *Attorney, Agent, or Firm*—Birch, Stewart, Kolasch & Birch, LLP

(57) ABSTRACT

A toolbox includes a cover, a body, and rotary locking devices arranged symmetrically on both sides of the toolbox which connect the body and the cover. Each rotary locking device includes an upper rabbet portion arranged on the cover of the toolbox, a lower rabbet portion arranged on the body of the toolbox, and a clasp plate connecting the upper rabbet portion and the lower rabbet portion. The cover of the toolbox can rotate by the upper rabbet portion rotating around the lower rabbet portion, and they will not disengage due to the locking plate. When opening the toolbox, the locking plate on one side of the tool box is disengaged from the upper rabbet portion, and the cover opens around the rotary locking device arranged on the opposite side of the toolbox. Thus, the toolbox can be opened from either of two sides of the toolbox.

5 Claims, 7 Drawing Sheets

TOOLBOX

TECHNICAL FIELD

The utility model relates to a toolbox, specifically to a toolbox that can be rotated in two directions to pen the cover of the toolbox.

BACKGROUND ART

In the prior art, the toolbox has a cover that can be opened. There are essentially rotary shafts on one side of the toolbox and locking devices on the other side. When the toolbox is to be used, the cover of toolbox is rotated along the rotary shafts, and the toolbox is opened or locked by the locking device on the other side of the toolbox. The toolbox has drawback, that is, the cover can be rotated only in one direction. Moreover, when the toolbox is want to be cleaned more completely, it is difficult and inconvenient to disassemble the cover from the toolbox.

SUMMARY OF THE UTILITY MODEL

The objective of the utility model is to provide a toolbox, wherein the cover of the toolbox can be opened by rotating in two directions, and the cover of the toolbox can be disassembled conveniently from the body of the toolbox.

To achieve this objective, the utility model provides a toolbox, the toolbox includes a cover, a body, and rotary locking devices arranged symmetrically on both sides of the toolbox which connect the body and the cover.

The rotary locking device includes: an upper rabbet portion arranged on the cover of the toolbox, a lower rabbet portion arranged on the body of the toolbox, and a clasp plate connecting the upper rabbet portion and the lower rabbet portion.

Said upper rabbet portion includes a locking slot arranged on the cover of the toolbox, a spindle securing bracket and a spindle fitted on the spindle securing bracket.

On the said clasp plate there are: rotary locking troughs I corresponding to the spindle and first spaces for inserting troughs I corresponding to the spindle securing bracket and the spindle, rotary shafts on either sides of bottom of the clasp plate, and a locking plate in the middle portion of the clasp plate, the locking plate is corresponding to the locking slot.

The lower rabbet portion include locking troughs II arranged on the body corresponding to the spindle, and second spaces for inserting troughs II arranged on the body corresponding to the spindle securing bracket and the rotary locking troughs. The lower rabbet portion further include shaft holes arranged on the body corresponding to the rotary shafts on the either sides of the clasp plate.

As a development of the present utility model, said shaft holes, which corresponds to the rotary shafts arranged on either side of the clasp plate, have slots on its ends which helps to fit the rotary shaft, the end potion of the rotary shaft were designed as inclined plane.

Since the present utility model provides above solution, the toolbox have rotary locking device arranged symmetrically on both sides of the toolbox, the rotary locking device connect the body and the cover, the clasp plate was fitted in the shaft holes of the lower rabbet portion, the spindle of the upper rabbet portion was fitted with the rotary locking troughs of the lower rabbet portion, via the locking plate of the clasp plate engaging with the locking slot arranged on the upper rabbet portion, thus, the cover of the toolbox can rotate around the rotary locking troughs of the lower rabbet portion by the spindle of the upper rabbet portion, and they will not disengage by the limitation of the locking plate. When opening the toolbox, the locking plate on one side is disengaged from the locking slot, the cover opens around the rotary locking device arranged on the opposite side of the toolbox. Thus, the toolbox can be opened from either of two sides. When the locking plate is disengaged on both sides, the cover of the toolbox can be disassembled from the body, which is a convenient feature.

DETAILED DESCRIPTION OF THE EMBODIMENT

Figure 1:
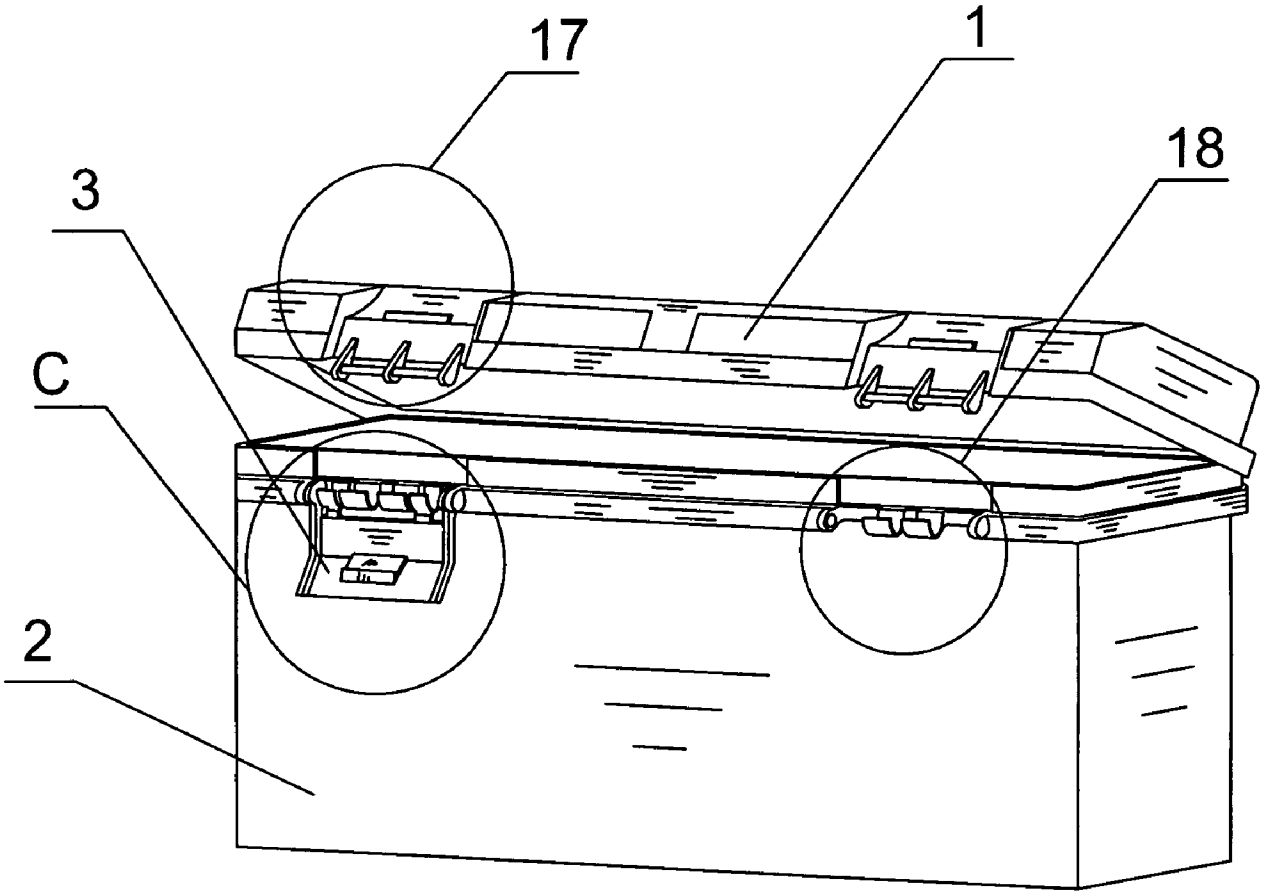
FIG. 1 is a schematic view showing the whole structure of the toolbox according to the present utility model.
Figure 2:
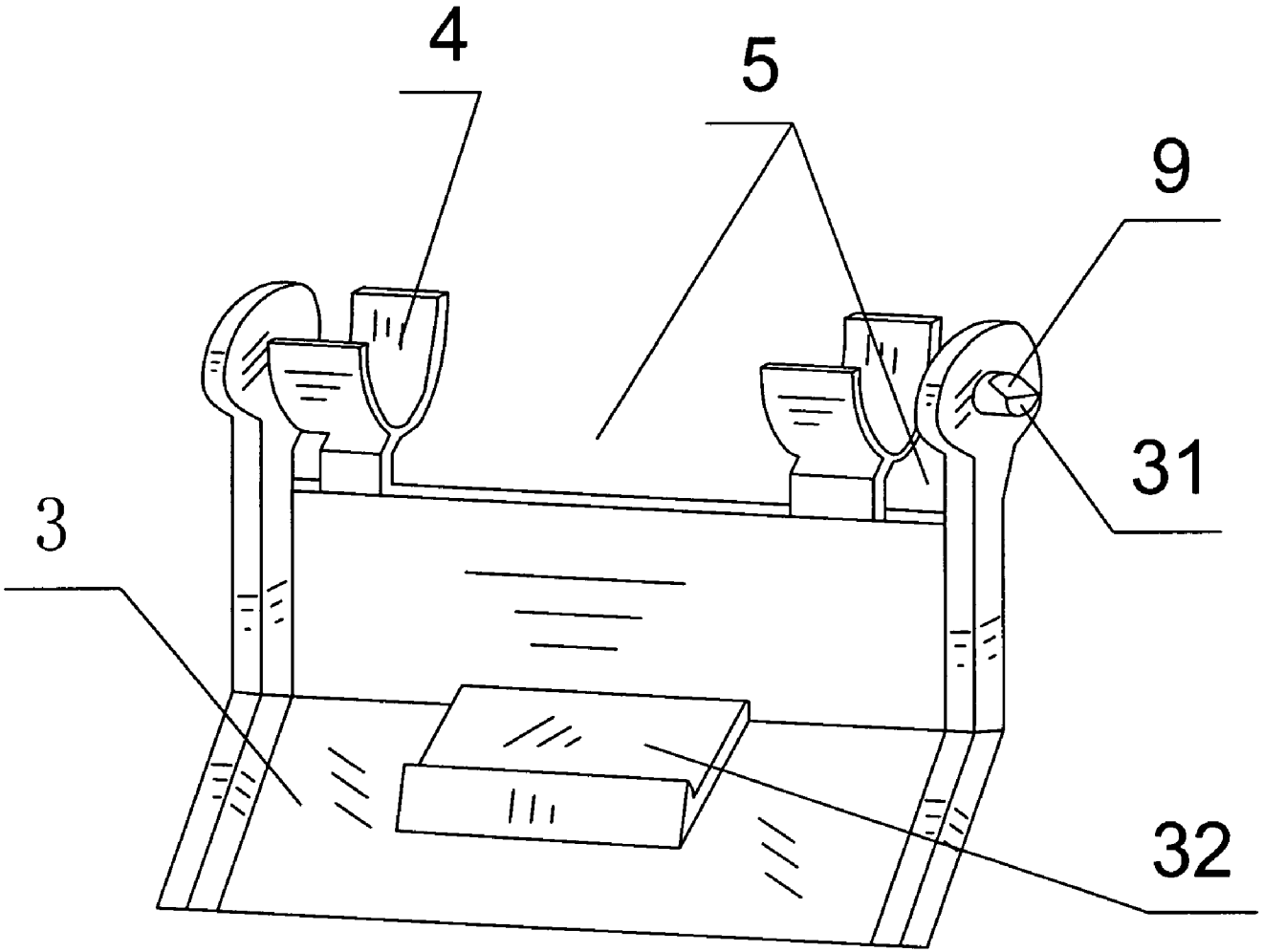
FIG. 2 is an enlargement schematic view of the structure of the clasp plate according to the present utility model.
Figure 3:
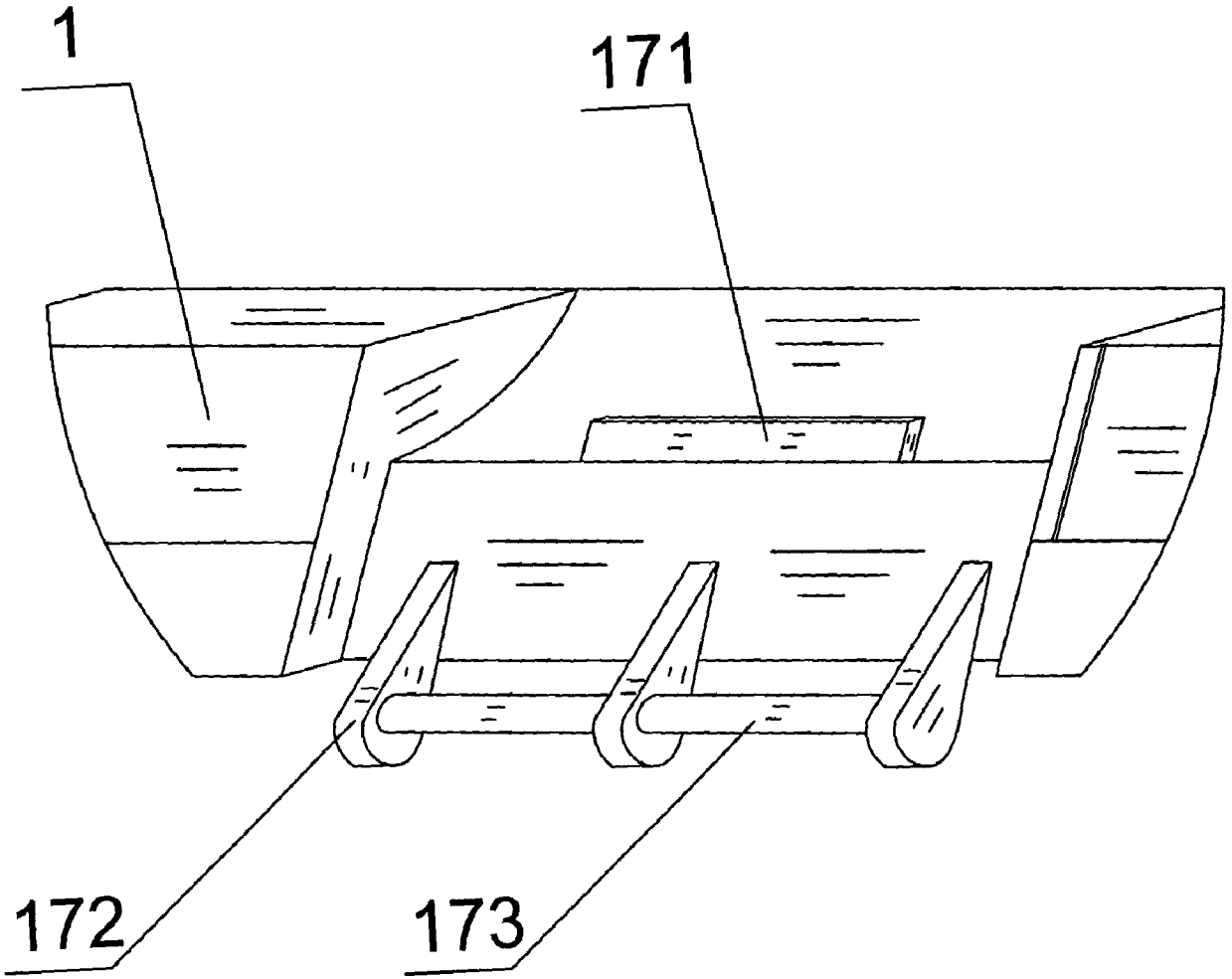
FIG. 3 is an enlargement schematic view of the structure of the upper rabbet portion in FIG. 1.
Figure 4:
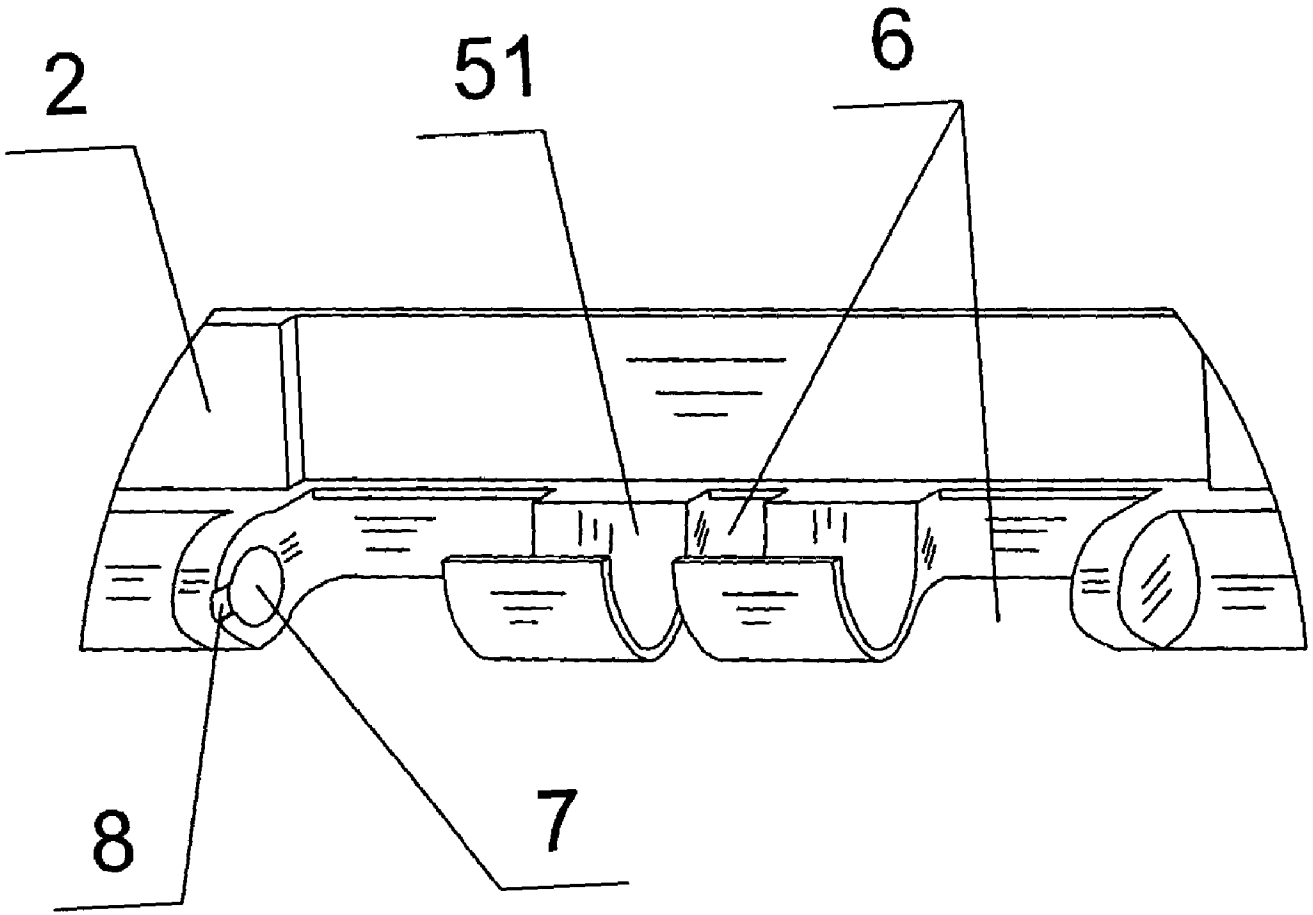
FIG. 4 is an enlargement schematic view of the structure of the lower rabbet portion in FIG. 1.
Figure 5:
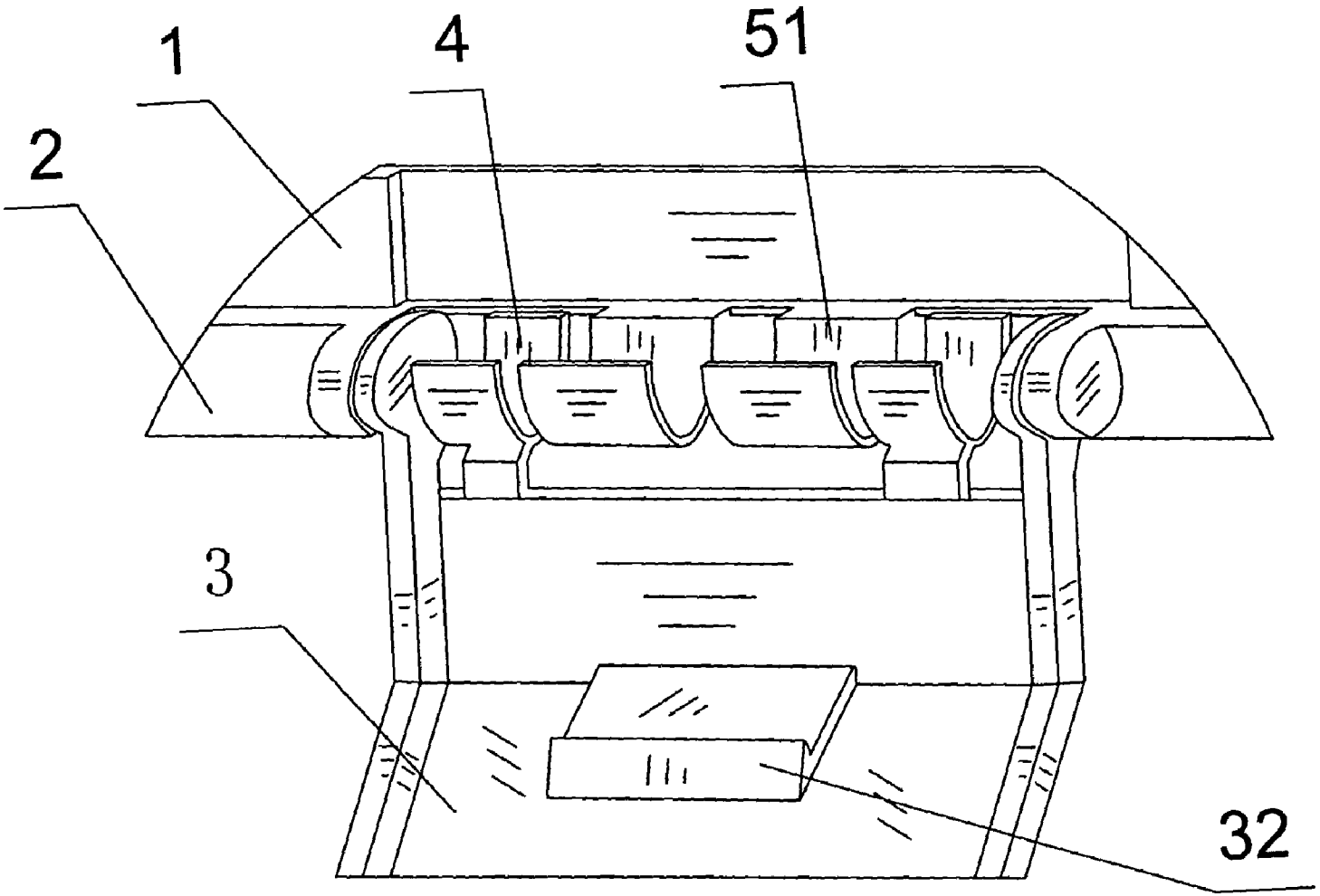
FIG. 5 is an enlargement schematic view at the "B" of the FIG. 1 (after the lower rabbet portion was fitted with the clasp plate)
Figure 6:
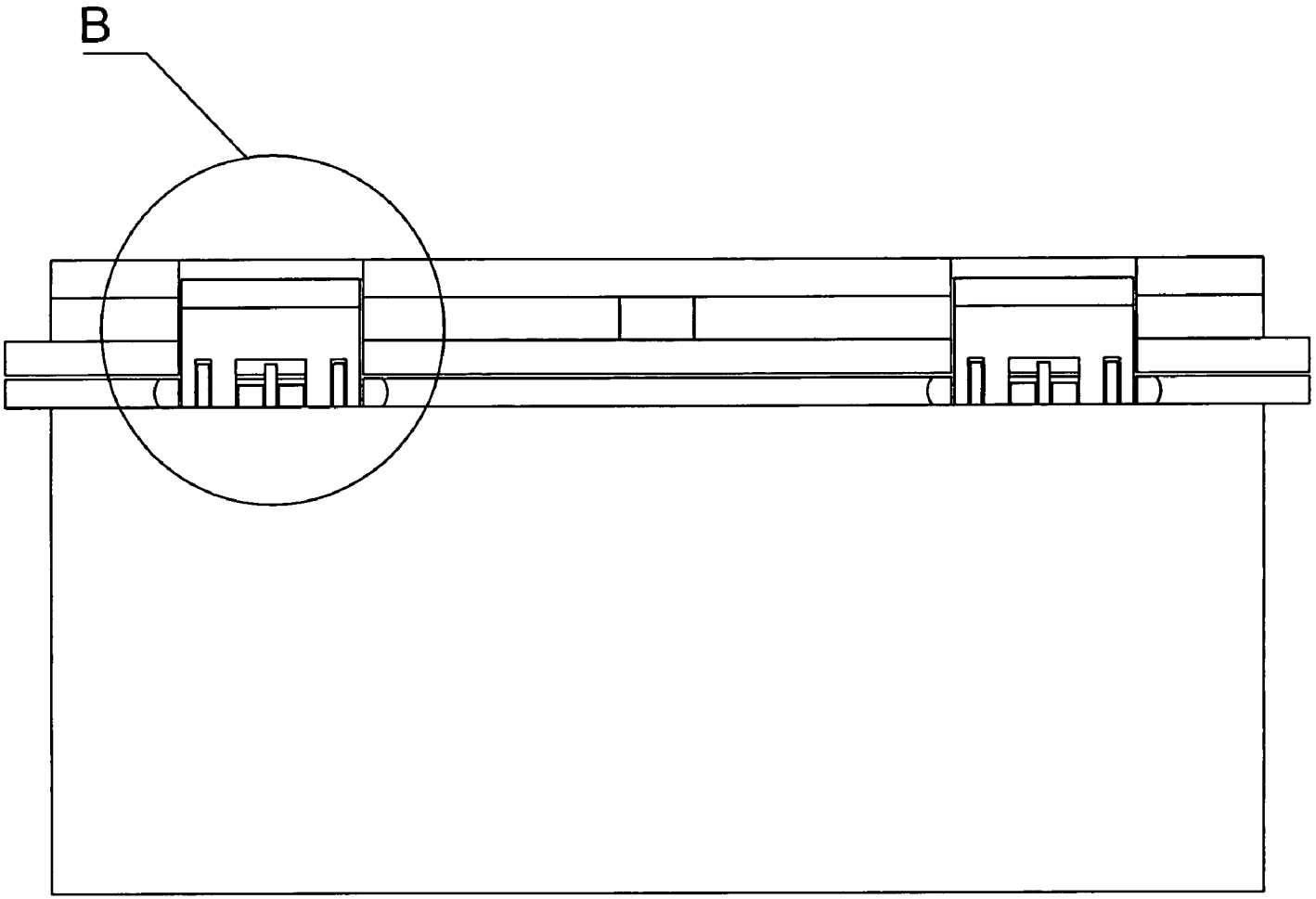
FIG. 6 is a schematic view of the upper structure of the clasp plate according to the present utility model.
Figure 7:
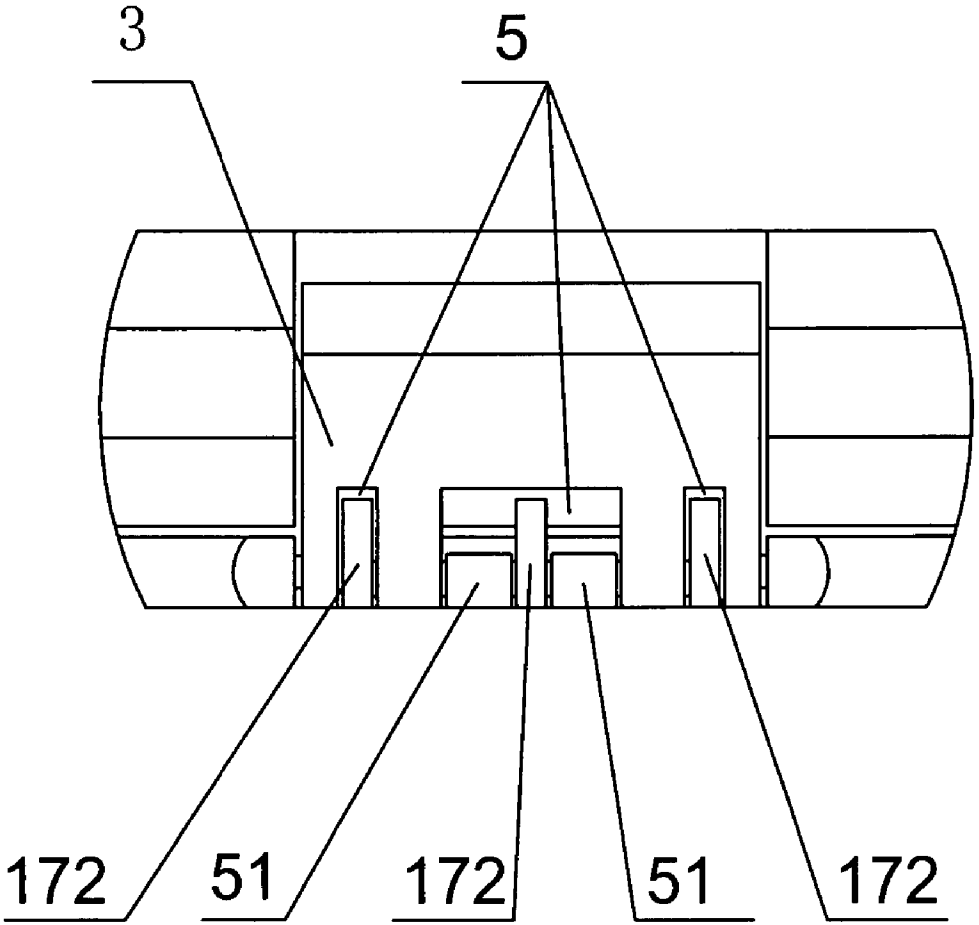
FIG. 7 is an enlargement schematic view of the structure at "C" of the FIG. 6.

As shown in FIG. 1 to FIG. 7, according to the utility model the toolbox includes a cover 1, a body 2, and rotary locking device arranged symmetrically on both sides of the toolbox, and the rotary locking device connects the body and the cover, said rotary locking device includes an upper rabbet portion 17 arranged on the cover of the toolbox, a lower rabbet portion 18 arranged on the body of the toolbox, and a clasp plate 3 connecting the upper rabbet portion 17 and the lower rabbet portion 18, the upper rabbet portion 17 includes a locking slot 171 arranged on the cover of the toolbox, a spindle securing bracket 172 and a spindle 173 fitted on the spindle securing bracket 172, on the clasp plate 3 there are rotary locking troughs I 4 corresponding to the spindle 173 and first spaces 5 for inserting troughs I corresponding to the spindle securing bracket 172 and the spindle 172, the clasp plate 3 on it's either sides provided with rotary shafts 31, and on it's middle portion provided with a locking plate 32. The lower rabbet portion 18 include locking troughs 51 arranged on the body 2 corresponding to the spindle 173, and second spaces 6 for inserting troughs 51 arranged on the body 2 corresponding to the spindle securing bracket 172 and the rotary locking troughs I 4. The lower rabbet portion 18 further include shaft holes 7 arranged on the body 2 corresponding to the rotary shafts 31 on the either sides of the clasp plate 3, each the shaft hole 7 have slot 8 which helps to fit the rotary shaft 31, the end potion of the rotary shaft 31 were designed as inclined plane 9.

According to the toolbox of the present utility model, the toolbox have rotary locking device arranged symmetrically on both sides of the toolbox which connect the body and the cover, the clasp plate 3 was fitted in the shaft holes 182 of the lower rabbet portion 18, the spindle 173 of the upper rabbet portion 17 was fitted with the rotary locking troughs I 4 of the lower rabbet portion 18, via the locking plate 32 of the clasp plate 3 engaging with the locking slot 171 arranged on the upper rabbet portion 17, thus, the cover of the toolbox can rotate around the rotary locking troughs I 4 of the lower rabbet portion by the spindle 173 of the upper rabbet portion, and they will not disengage by the limitation of the locking plate 32, when the toolbox is to be open, the locking plate was disengage from the locking slot, the toolbox was opened around the rotary locking device arranged on one both side, thus the toolbox can be opened in two directions, when the locking plate was disengaged on either sides, the cover of the toolbox can be disassembled from the body, which is very convenient.

The invention claimed is:

1. A toolbox comprising:

a cover;

a body; and rotary locking devices symmetrically arranged on both sides of the toolbox, the rotary locking devices being adapted to connect the cover and the body, wherein each of the rotary locking devices includes an upper rabbet portion arranged on the cover of the toolbox, a lower rabbet portion arranged on the body of the toolbox, and a clasp plate connecting the upper rabbet portion and the lower rabbet portion, and wherein each of the upper rabbet portions includes a locking slot arranged on the cover of the toolbox, a spindle securing bracket, and a spindle attached to the spindle securing bracket, the bracket and the spindle being disposed outwardly and downwardly with respect to a lower peripheral edge of the cover.

2. The toolbox according to claim 1, wherein the clasp plate includes:

a pair rotary locking first troughs, first spaces disposed on each side of the first troughs in an axial direction of the first troughs, a locking plate disposed in a central portion of the clasp plate, and a rotary shaft extending in the axial direction from opposite axial ends of the clasp plate, wherein the first troughs are adapted to engage the spindle of the upper rabbet portion, the first spaces are adapted to engage respective portions of the spindle securing bracket of the upper rabbet portion.

3. The toolbox according to the claim 2, wherein each of the rotary shafts has an end formed with an inclined plane section, and each of said shaft holes has a slot which is adapted to receive the inclined end portion of the respective rotary shaft.

4. The toolbox according to claim 1, wherein the lower rabbet portion of the body includes a second locking trough, second spaces disposed on each side of the second trough in an axial direction of the second trough, and a pair of shaft holes opening toward each other from opposite ends of the lower rabbet portion wherein the second locking trough is adapted to engage with the spindle of the upper rabbet portion, the second spaces are adapted to engage respective portions of the spindle securing bracket of the upper rabbet portion, and the shaft holes being adapted to engage the rotary shafts extending in the axial direction from opposite axial ends of the clasp plate.

5. The toolbox according to the claim 4, wherein the at least on second locking trough on the lower rabbet portion includes two second locking troughs, and when a clasp plate is engaged with the lower rabbet portion, the two second locking troughs are disposed between a pair of first locking troughs of the clasp plate.

* * * * *